United States Patent [19]

Muttart

[11] Patent Number: 4,754,957

[45] Date of Patent: Jul. 5, 1988

[54] SHOCK ABSORBER FOR LINES

[76] Inventor: Vincent H. Muttart, 902 Rockaway Dr., Placentia, Calif. 92670

[21] Appl. No.: 83,468

[22] Filed: Aug. 10, 1987

[51] Int. Cl.[4] ..... F16M 1/00; F16F 1/00; F16G 11/00; B63B 21/00

[52] U.S. Cl. ..... 267/136; 114/215; 114/230; 248/613; 267/69; 267/166

[58] Field of Search ..... 267/69, 70, 71, 136, 267/166, 167, 170, 286, 73, 74; 248/611, 613; 114/213, 215, 230; 254/277, 389

[56] References Cited

U.S. PATENT DOCUMENTS

| | | | |
|---|---|---|---|
| 165,036 | 6/1875 | Smith | 114/301 |
| 384,008 | 6/1888 | Wheeler | 267/71 |
| 534,646 | 2/1895 | Harmon et al. | 267/71 |
| 608,344 | 8/1898 | Nesmith | 130/5 G |
| 760,518 | 5/1904 | Bailey | 416/83 |
| 855,899 | 6/1907 | Mercer | 24/32 |
| 973,906 | 10/1910 | Askegren | 114/213 X |
| 1,482,918 | 2/1924 | Dutcher | 267/72 |
| 2,364,081 | 12/1944 | Lambert | 267/69 |
| 2,675,977 | 4/1954 | Von Berlichingen et al. | 248/54 |
| 2,878,013 | 3/1959 | Piodi | 267/69 |
| 3,353,817 | 11/1967 | Bollinger | 267/69 |
| 3,402,925 | 9/1968 | Schwiebert | 267/71 |
| 3,506,233 | 4/1970 | Holben et al. | 248/358 |
| 3,869,114 | 3/1975 | Schneider | 267/69 |
| 4,022,450 | 5/1977 | Smith, Jr. | 267/73 |
| 4,192,493 | 3/1980 | Koughan | 267/74 |
| 4,515,100 | 5/1985 | Grierson | 114/97 |
| 4,597,351 | 7/1986 | Brainard, II | 114/230 |
| 4,627,375 | 12/1986 | Davis | 114/230 |

FOREIGN PATENT DOCUMENTS 2267487 11/1975 France .

*Primary Examiner*—Andres Kashnikow
*Assistant Examiner*—Robert J. Oberleitner
*Attorney, Agent, or Firm*—Richard L. Gausewitz

[57] ABSTRACT

The instant invention is an apparatus for introducing resilient forces into a line when the line is tensioned. The apparatus comprises a housing to form and maintain a section of line into a loop or bight portion lying generally in planes substantially parallel to the line portions exterior of the housing when the line is in a tensioned condition. The apparatus further contains a resilient member to maintain the loop or bight in a relatively large diameter condition when the line is not tensioned. The resilient member resists a lessening in diameter of the loop or bight upon tensioning of the line.

17 Claims, 2 Drawing Sheets

FIG. 1.
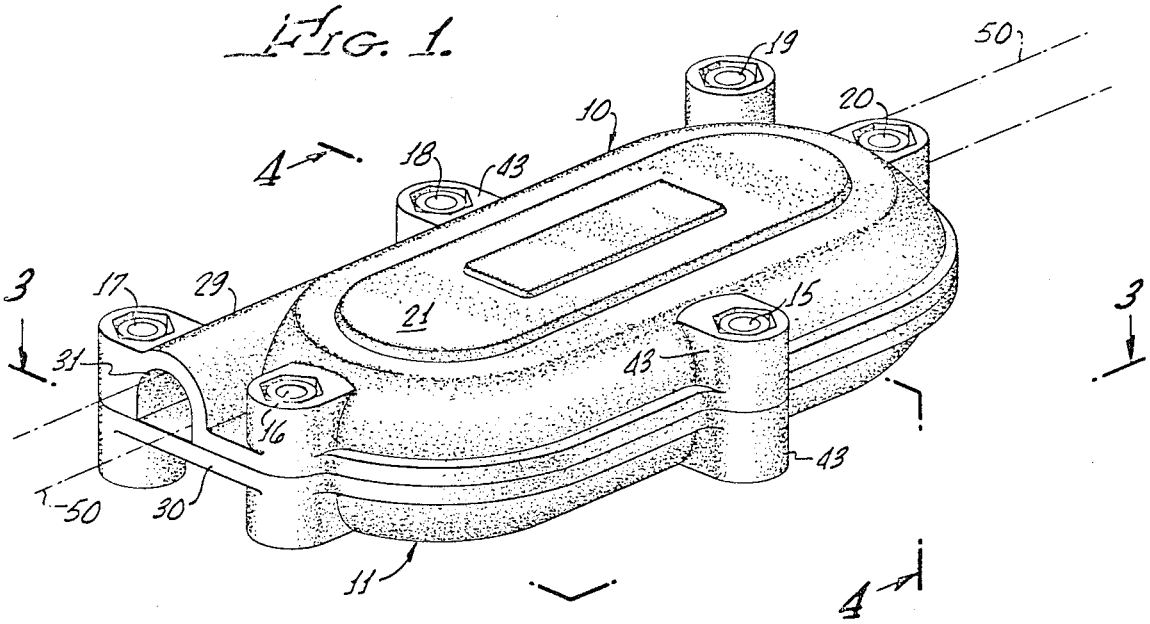
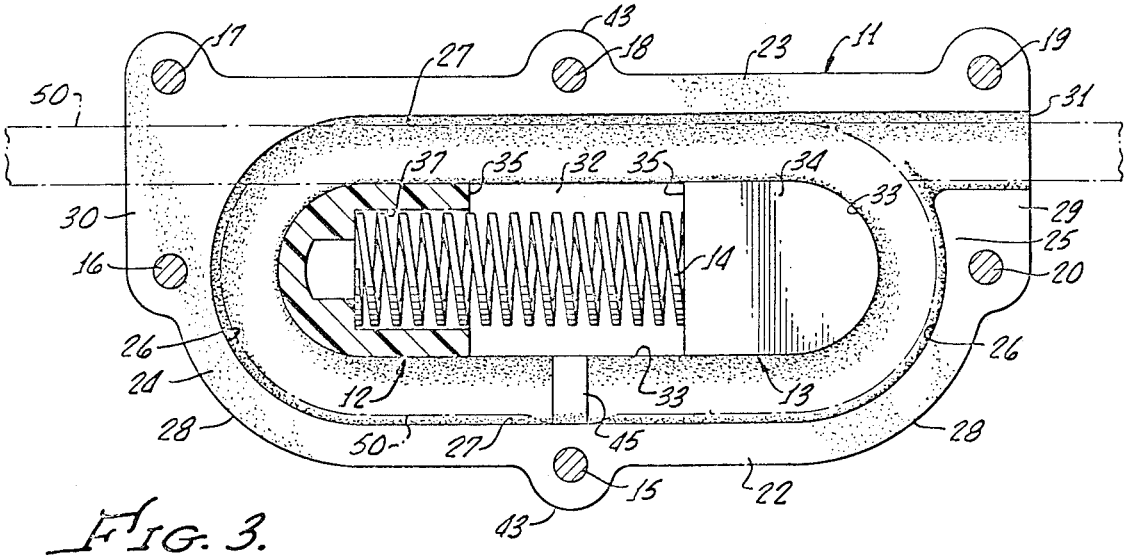
FIG. 3.
FIG. 4.
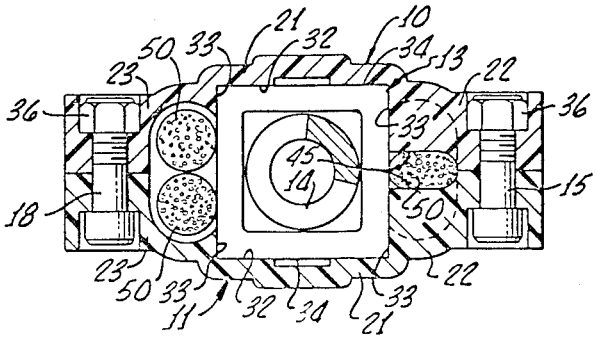

SHOCK ABSORBER FOR LINES

BACKGROUND OF THE INVENTION

For at least a century, there have been various approaches to the problems of (1) absorbing or dampening the shocks, jerks or surges that are generated in lines or ropes under certain conditions, and (2) introducing resilient forces into a line when it is tensioned. One such problem is present where a boat is moored to a dock or pier, and waves repeatedly jerk the line as soon as it becomes taut. It is also present when a boat is being stopped upon coming into a dock. Such jerking can generate large forces that strain the line (and the elements to which it is connected) to a high degree, can damage the boat, and can cause occupants of the boat to fall.

Prior-art approaches toward solution of the problem have been deficient in one or more of the following (and other) ways: relatively high cost; inability to dampen sufficiently large forces; inability to keep the boat moored even if the shock absorber breaks; inability to use helical compression spring means; absence of a casing that fully encloses the mechanism; and inability to permit a lengthening of the line that is much larger than the shortening of compression spring means incorporated in the shock absorber.

SUMMARY OF THE INVENTION

The present shock absorber does not have any of the deficiencies mentioned in the preceding paragraph. It comprises means to hold a portion of the line in a loop or bight that lies generally in or parallel to the plane containing—when the line is tensioned—the portions on opposite sides of the shock absorber. The apparatus further comprises resilient means to resist reduction in the diameter of the loop or bight.

In the preferred embodiment, the loop is wound around two sliders that are maintained in spaced-apart condition by a helical compression spring. The loop, sliders, spring and adjacent line portions are confined within a casing. When tension is generated in the line, the sliders move toward each other against the bias of the compression spring, and when the tension becomes sufficiently great the sliders engage each other to prevent further reduction in loop size. In the event the apparatus were to break, there would not be any break in the line, and consequently no freeing of the boat to which the line is connected.

Means are provided to prevent the shock absorber from sliding along the line. Such means preferably comprise means to grip the central region of the loop.

In the preferred embodiment, the casing is formed of two casing halves that are identical to each other and come out of the same mold cavity—just as the sliders are identical to each and come out of their same mold cavity. Thus, only two mold cavities need by employed to generate the apparatus comprising a casing, two sliders and the helical compression spring.

BRIEF DESCRIPTION OF THE DRAWINGS

FIG. 1 is an isometric view of the apparatus, the line being shown in phantom;

FIG. 3 is a horizontal sectional view on line 3—3 of FIG. 1, but showing the spring and one slider in top plan; and FIG. 4 is a transverse vertical sectional view on line 4—4 of FIG. 1.

DETAILED DESCRIPTION OF THE PREFERRED EMBODIMENT

Figure 2:
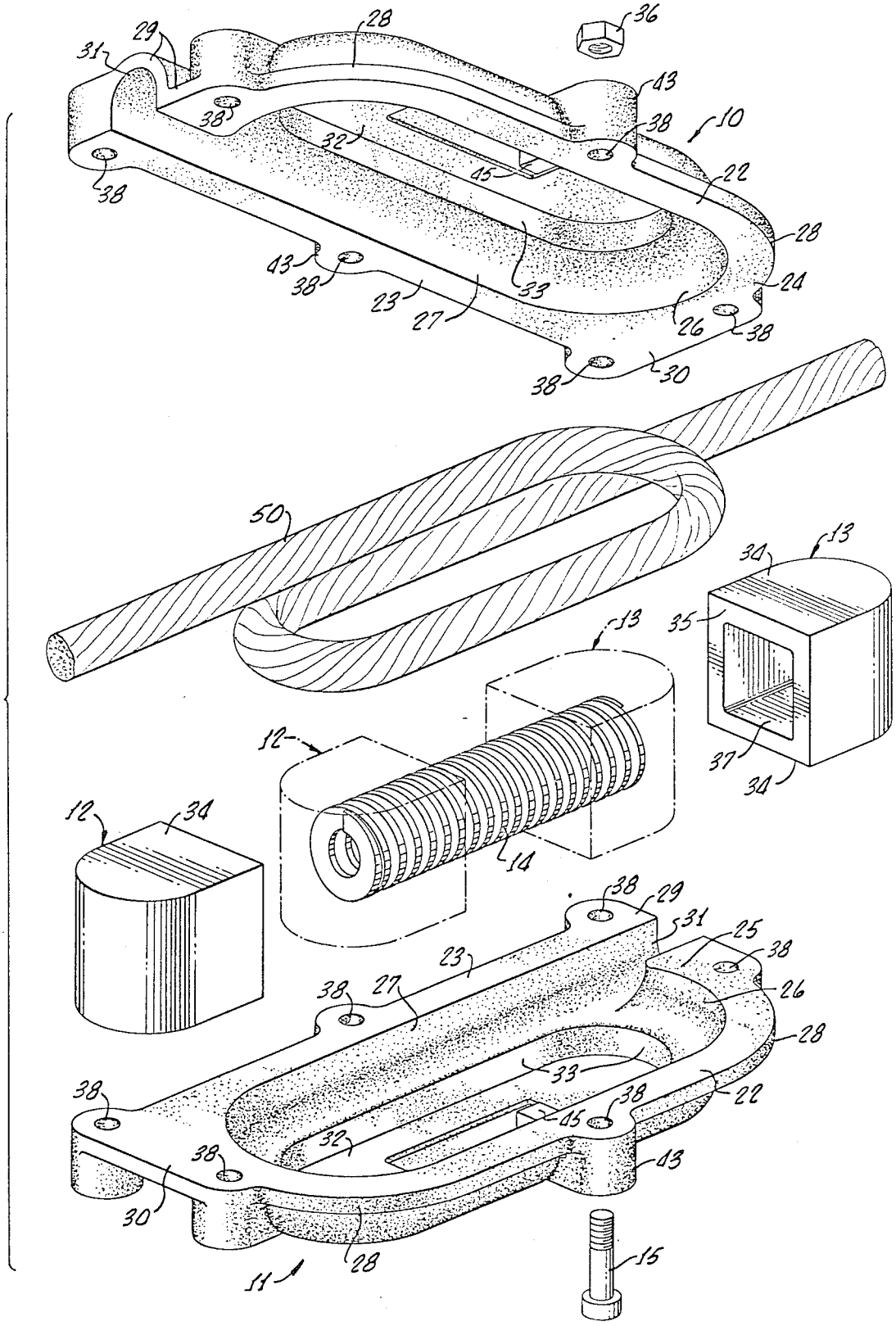
FIG. 2 is an exploded view of the apparatus.

The preferred embodiment comprises two identical casing halves 10 and 11, two identical sliders 12 and 13, and a helical compression spring 14. The casing halves 10, 11 are secured together by bolts 15–20 to thereby confine the sliders 12, 13 and spring 14 as well as the line or rope with which they are associated.

Each casing half 10, 11 is an elongate member what will, for convenience, be described as having a "large" wall 21. This convention is employed because such wall 21 is the top wall of one casing half 10 or 11, and the bottom wall of the other casing half 10 or 11. Extending from the longer edge portions of large wall 21 are half-sides 22 and 23, and extending from the shorter edges of large wall 21 are half-ends 24 and 25. The half-sides 22 and 23 are straight and parallel to each other.

Referring next to half-ends 24 and 25, these have semicircular interior surfaces 26 that merge with the straight interior surfaces 27 of half-sides 22 and 23. All of such interior surfaces are rounded, in transverse section, to correspond generally to the generally cylindrical surface of the line that passes adjacent thereto as described below. Those quadrants of the semicircular interior surfaces 26 that merge with the straight interior surface 27 of half-side 22 are parallel to quadrant-shaped exterior surface regions 28 of the half-ends 24 and 25. On the other hand, those quadrants of the interior surfaces 26 that merge (except for openings described below) with the straight interior surface 27 of half-side 23 are bounded by relatively thick boss portions 29 and 30 of the half-ends 25 and 24, respectively.

Each boss portion 29 forms an extension of straight halfside 23 at one end of each casing half, while each boss portion 30 extends from such half-side 23 at the other end of each casing half. As a result, the straight half-sides 23 may be thought of as being much longer than the opposed straight half sides 22. Stated otherwise, the boss portions 29 and 30 increase the length of the straight half-side 23 of each casing half into the half-ends of such casing half.

Half-end 25 and its boss portion 29 have formed therethrough a groove 31 of sufficient width and depth to freely receive the line with which the shock absorber is associated. Such groove 31 has a bottom wall that is rounded in transverse section, and one side of such groove and bottom wall merges with the correspondingly-rounded straight interior surface 27 of half-side 23.

Half-sides 22, 23 and half-ends 24, 25, as well as boss portions 29, 30 of each casing half 10, 11, terminate in a single planar surface that is parallel to large wall 21. Thus, when the first and second casing halves 10 and 11 are mated together, with such planar surfaces in engagement with each other, one casing half being inverted relative to the other, there is a formed the complete casing. Such casing has a line-confining "track" shaped much as a track used for horse racing.

The grooves 31 of the first and second casing halves 10 and 11 are generally in line with each other but in slightly different planes. Thus, one groove 31 is on one side of the central or medial plane of the casing (such central or medial plane containing the above-stated planar surfaces), while the other groove 31 is on the other side of such central plane. The amount of offset of the line portions on opposite sides of the loop or bight is about one line diameter.

Formed in the large wall 21 of each casing half 10, 11 is a slide surface 32 bounded by a wall 33. Such wall has straight sides and semicircular ends corresponding to the above-indicated "track". When the casing halves 10, 11 are in mated condition, the slide surfaces 32 slidingly engage, and the side wall 33 confines, the first and second sliders 12 and 13, respectively.

As above indicated, sliders 12, 13 are identical to each other. Each has opposed flat exterior surfaces 34 that slide on surfaces 32. The ends of such exterior surfaces are semicircular so as to correspond to the end portions of side walls 33. The portions of the sliders remote from the semicircular ends thereof are preferably cut off square so as to lie in planes perpendicular to the longitudinal axis of the shock absorber. There are thus provided end surfaces 35 that are adapted to engage each other and serve as stop surfaces when the force being absorbed by the shock absorber is particularly high.

There are provided in the facing surfaces of the sliders 12, 13 deep recesses or cavities 37 each of which is adapted to receive one end portion of the helical compression spring 14. Such recesses or cavities are preferably square in transverse section, and preferably communicate with smaller cavities at the inner regions thereof in order to minimize the amount of material employed in making the sliders.

Each of the casing halves 10, 11 has bores (and associated counterbores) 38 spaced around the exteriors of the half-sides, half-ends and bosses thereof. The bores are through boss portions 29 and 30 and through other exterior boss portions 43 adapted to provide strength to the assembly while minimizing use of material. The bolts 15–20 pass through and are received by such bores and associated counterbores, thus assembling the casing halves, sliders and compression spring into the shock absorber. The nuts 36 (FIG. 4) for bolts 15–20 seat in the counterbores, as do the boltheads. The walls of the counterbores are hex shaped, as are the counterbores, to minimize the need for wrenches.

Means are provided to grip the line in order to ensure that the shock absorber does not slide along it as the line is repeatedly tensioned and relaxed. Such gripper means preferably comprises a gripper wall 45 provided in each casing half 10, 11. The gripper wall is centered in the straight interior surface 27 diametrically opposite the side of the shock absorber at which the line enters and leaves. Each wall 45 is sufficiently high that it will somewhat pinch or compress the line. Accordingly, that portion of the line may not move relative to the shock absorber. The line-engaging region of each wall may be somewhat serrated or toothted if desired. As an additional or alternative construction, there may be suitable resilient means, such as sponge rubber, to effect the line-gripping function.

It is emphasized that the portion of the line engaged by the gripper means 45 does not move when the line is jerked or tensioned. The "stretching" of the line is uniform on opposite sides of the gripper means 45.

To assemble the apparatus, the sliders 12, 13 are mounted on opposite ends of the helical compression spring 14, and the assembly of sliders and spring is mounted on the slide surface 32 of one of the casing halves 10, 11, the relationship being such that side wall 33 extends around the adjacent the sliders 12, 13.

A line 50, preferably a conventional line formed of three twisted nylon cords, is then disposed in the groove 31 and the track of such one casing half, as shown in FIG. 5. Accordingly, the line is formed into a loop or bight that extends around the sliders 12, 13.

Such loop or bight lies generally in the same plane as the line portions on opposite sides of the shock absorber (that is to say, not within the casing) when the line is in tensioned condition. Furthermore, such loop or bight is disposed on one side of an axis passing through the inlet and outlet ends of the shock absorber.

Then, the remaining one of the casing halves 10, 11 is mounted over the line, sliders and spring, following which the bolts 15–20 are inserted through the bores 38 and then tightened with respect to their nuts 36. The gripper walls 45 then somewhat pinch the line at its neutral point, but there is no pressure on any other portion of the line nor on either slider. On the other hand, the line and sliders are effectively confined.

It is then merely necessary to connect the end (or other) portions of the line to desired points, for example to posts and/or cleats the boat and pier. The shock absorber may be disposed on the deck of the boat, on the pier, or may be suspended between boat and pier.

Preferably, each casing half is formed of nylon containing 30% glass fibers. Preferably, each slider is made of Delrin.

The sizes of the casing halves, springs and sliders depend upon the diameter of the line to be associated therewith. For example, for a $\frac{3}{4}$ inch line, the shock absorber is about 11 inches long, while for a $\frac{3}{8}$ inch line, the shock absorber is somewhat under 6 inches long.

The following spring rates and travel distances to "solid" are given by way of example. Travel to "solid" denotes how far the two sliders must move toward each other before there is solid contact between the spring helix portions or between the adjacent ends of the sliders, following which further spring compression is impossible.

For a shock absorber adapted to hold a line $\frac{3}{4}$ inch in diameter, the preferred string rate is 60 pounds per 0.10 inch, and the total travel to solid is 2.3 inches. Thus, the total tension that the apparatus may absorb (before "solid") is about 1,400 pounds. For a line $\frac{5}{8}$ inch in diameter, the spring rate is preferably 56 pounds per 0.10 inch, and the total travel to solid is 1.87 inches. Thus, the total tension is about 1,000 pounds. Referring next to a shock absorber adapted to receive a line $\frac{1}{2}$ inch in diameter, the spring rate is preferably 42 pounds per 0.10 inch, and the total travel to solid is 1.5 inches. Thus, the total tension is about 630 pounds. For a $\frac{3}{8}$ inch line, the spring rate is preferably 36 pounds per 0.10 inch, and the total travel to solid is 1.04 inches, resulting in a total tension of 375 pounds.

It is an important feature of the present shock absorber that the amount of "stretching" of the line resulting from the presence of the present apparatus is double the amount of compression of the spring. When the sliders move toward each other as the line is tensioned, a region of line emanates from each of the two outlets, such region at each outlet being equal to the distance that the sliders move toward each other. Thus, if the $\frac{3}{4}$ inch shock absorber is so tensioned that the spring is compressed 2 inches, the total amount of "stretching" of the line will be 4 inches. When there is such a substantial amount of line elongation, there is time for the apparatus to function properly and relatively slowly—with minimized tendency toward sudden stops or jerks.

The amount of line "stretching" for a given shortening of the spring or other resilient means can be increased by adding an additional loop or bight in parallel and adjacent relationship to the loop or bight shown in the drawings.

The foregoing detailed description is to be clearly understood as given by way of illustration and example only, the spirit and scope of this invention being limited solely by the appended claims.

What is claimed is:

1. Apparatus for introducing resilient forces into a line when said line is tensioned, said apparatus comprising:

(a) means to form and maintain a section of the line into a loop or bight means lying generally in planes substantially parallel, when the line is in tensioned condition, to the line portions exterior to said apparatus, and (b) resilient means to maintain said loop or bight means in relatively large-diameter condition when said line is not tensioned, said resilient means resiliently resisting lessening in the diameter of said loop or bight means and thus introducing resililent forces into the line upon tensioning of such line.

2. The invention as claimed in claim 1, in which said loop or bight means is a single loop or bight.

3. The invention as claimed in claim 2, in which said loop or bight lies on one side of an axis that passes through the line portions on opposite sides of the apparatus when the line is in tensioned condition.

4. The invention as claimed in claim 1, in which said means to form and maintain the single loop or bight has one end of which is offset by substantially a single line diameter from the other end thereof.

5. The invention as claimed in claim 1, in which said resilient means comprises helical compression spring means.

6. Apparatus for introducing resilient forces into a line when said line is tensioned, said apparatus comprising:

(a) elongate helical compression spring means, (b) first and second line support means, said first line support means being operatively associated with one end of said spring means, said second line support means being operatively associated with the other end of said spring means, (c) a line part of which is wound around said first and second line support means, and (d) means to maintain said line part in said wound condition during and after tensioning of said line, said spring means resiliently resisting movement of said line support means towards each other when said line is tensioned, and thus resisting reduction in the diameter of said wound part of said line when said line is tensioned, whereby to introduce resilient forces into said line when said line is tensioned.

7. The invention as claimed in claim 6, in which said means to maintain comprises a casing confining said spring means, said line support means and said line part.

8. The invention as claimed in claim 6, in which said line part wound around said first and second line support means is only a single loop or bight.

9. The invention as claimed in claim 8, in which gripper means are provided to engage a central portion of said single loop or bight to prevent undesired movement of the apparatus along said line.

10. Apparatus responsive to tensioning of a line to create resilient forces tending to reduce the length of said line, said apparatus comprising:

(a) a casing having an inlet for a line and an outlet for such line, said inlet and outlet being spaced from each other, and (b) means in said casing to cause the portion of line therein to bend away from an axis extending between said casing inlet and said casing outlet, to extend for a substantial distance away from said axis, and then to bend back to such axis and emanate through said outlet, said means in said casing comprises resilient means, said resilient means tending to resist resiliently any increase in the length of said line, and tending to reduce the length of said line.

11. The invention as claimed in claim 10, in which said resilient means is a helical compression spring.

12. The invention as claimed in claim 10, in which said means in said casing also comprises a slider element having said line portion bent around it, and in which said resilient means acts on said slider element.

13. A shock absorber for a line that moors a boat, said shock absorber comprising:

(a) a casing having track means therein shaped to maintain a line portion within said casing in a loop or bight, (b) first and second sliders mounted in said casing within said loop or bight, said sliders having portions of said loop or bight engaged therewith, and (c) resilient means tending to resist said sliders from moving towards each other and thus tending to prevent reduction in the size of said loop or bight, whereby said sliders and resilient means absorb shocks generated in said line.

14. The invention as claimed in claim 13, in which means are provided in said casing to guide said sliders in such directions that they can only move towards and away from each other.

15. The invention as claimed in claim 13, in which said resilient means comprises a helical compression spring.

16. The invention as claimed in claim 13, in which gripper means are provided in said casing to engage and hold a line portion at the center of said loop or bight, thus preventing said shock absorber from moving along said line.

17. The invention as claimed in claim 13, in which said casing means comprises first and second identical casing halves each having a large wall, half-side and half-end walls, and a groove through which a line may enter or leave the casing, said first and second casing halves being adapted to mate with each other whereby said line enters one of said grooves and exits through the other, and in which means are provided to removably secure said casing halves to each other.

* * * * *